US008161993B2

(12) United States Patent
Ratcliffe

(10) Patent No.: US 8,161,993 B2
(45) Date of Patent: Apr. 24, 2012

(54) SUBSEA SYSTEM AND METHOD FOR PROTECTING EQUIPMENT OF A SUBSEA SYSTEM

(75) Inventor: Anthony James Ratcliffe, Fettercairn (GB)

(73) Assignee: Chevron U.S.A. Inc., San Ramon, CA (US)

( * ) Notice: Subject to any disclaimer, the term of this patent is extended or adjusted under 35 U.S.C. 154(b) by 767 days.

(21) Appl. No.: 12/236,406

(22) Filed: Sep. 23, 2008

(65) Prior Publication Data

US 2010/0071775 A1 Mar. 25, 2010

(51) Int. Cl.
*F16K 11/10* (2006.01)
*F16K 17/02* (2006.01)

(52) U.S. Cl. ..... 137/12; 137/488

(58) Field of Classification Search ..... 137/488, 137/492.5, 12
See application file for complete search history.

(56) References Cited

U.S. PATENT DOCUMENTS

| | | | | |
|---|---|---|---|---|
| 4,161,960 | A | 7/1979 | Watkins | |
| 4,186,766 | A | 2/1980 | Snyder | |
| 4,319,603 | A | 3/1982 | Snyder | |
| 5,396,923 | A | 3/1995 | Allen | |
| 5,927,314 | A | 7/1999 | Velie et al. | |
| 6,116,268 | A | 9/2000 | Johnson | |
| 6,230,810 | B1 * | 5/2001 | Rivas | 166/357 |
| 7,044,156 | B2 | 5/2006 | Webster | |
| 7,258,508 | B2 | 8/2007 | McCoy et al. | |

OTHER PUBLICATIONS

PCT International Search Report and Written Opinion on PCT/US2009/057952 dated May 3, 2010, pp. 1-10.

J.G. Hoseth, EI Willmann, P. Roberts Implementation options for the subsea high integrity pipeline protection system (HIPPS) solution, OTC, 1997, 129-137.

J. Davalatah, H.B. Skeels, S. Corneliussen. "Current state of the art in the design of subsea HIPPS systems", OTC, SCASA, 2004, 155-159.

G. Gall, P. Turner, R. Seaton. "Reliability of subsea control systems: HIPPS a case study" SCADA, 2002, 1-16.

S. Patni, J Dacalatah, "Subsea HIPPS: A way to develop high-pressure subsea fields", SPE, 2005, 155-159.

P. Roberts, K. Haugen, R Phillips, W. Wason Long offset deepwater tieback economics facilitated through the use of HIPPS systems, DOT, 2005, 1-14.

* cited by examiner

*Primary Examiner* — Kevin Lee
(74) *Attorney, Agent, or Firm* — Nicholas F. Gallo; Merchant & Gould P.C.; Melissa Patangia

(57) ABSTRACT

A subsea system comprises a wellbore within a reservoir, equipment downstream of the wellbore, and a barrier connected to the equipment. The equipment is rated for a maximum pressure that is less than a maximum reservoir pressure and equal to or greater than the maximum reservoir pressure less external hydrostatic pressure experienced by the equipment. The barrier is rated for a maximum pressure that is equal to or greater than the maximum reservoir pressure.

20 Claims, 4 Drawing Sheets

SUBSEA SYSTEM AND METHOD FOR PROTECTING EQUIPMENT OF A SUBSEA SYSTEM

BACKGROUND OF THE INVENTION

1) Field of the invention

The present invention relates to a subsea system and an associated method for protecting equipment of a subsea system, e.g., for use in a subsea system for transporting oil, gas, and or other fluids from a subsea well.

2) Description of Related Art

Subsea systems are usually designed to work across high pressure differentials (e.g. full wellhead shut-in pressure versus operating flow pressure) even when normal operating flow pressure is only a small fraction of full wellhead shut-in pressure, which dramatically increases project capital expenditures. Subsea systems can comprise protection systems to deal with occasional high pressure differentials, for example, by retaining high pressure within a section of the system capable of withstanding the pressure, which prevents the remainder of the system from being exposed to pressure which may exceed its pressure rating. Thus, the protection systems safeguard equipment of the subsea system as well as maintain safe operation of the subsea system, by protecting the equipment from excessive pressure (e.g., pressure exceeding its pressure rating) that might compromise the operation of the equipment.

U.S. Pat. No. 7,044,156 discloses a protection system for a pipeline, for example to safeguard production fluid pipelines in sub-sea fluid extraction wells, such as hydrocarbon extraction wells. U.S. Pat. No. 5,396,923 discloses a surge relief apparatus for sensing, tracking, and responding to pressure changes in a flow system to prevent damage caused by transient pressure changes in the flow system having one or more conduits with fluid. U.S. Pat. No. 4,319,603 discloses a safety valve system to maintain the flow of fluid through a flow line when the line pressure is less than a predetermined maximum and greater than a predetermined minimum which includes a hydraulically actuated safety valve inserted in the flow line. U.S. Pat. No. 4,186,766 relates generally to a system for controlling flow through a line by means of a valve which is moved between flow-controlling positions by a fluid-operated actuator. U.S. Pat. No. 4,161,960 discloses a well safety valve adapted to be positioned in a well tubing and closed on either a predetermined high tubing pressure or a predetermined low tubing pressure.

What is needed is a new subsea system that allows for reduced project capital expenditures while maintaining a high level of safety of the subsea system (i.e., preventing damage resulting in malfunction/inoperability of equipment of the subsea system).

SUMMARY

Provided is a subsea system that allows for reduced project capital expenditures by taking into account external hydrostatic pressure experienced by subsea equipment As a result, the required pressure rating of the subsea equipment is reduced. A high level of safety of the subsea system is maintained by including a protection system (i.e., a barrier) within the subsea system.

In particular, the presently disclosed subsea system comprises a wellbore within a reservoir, equipment downstream of the wellbore, and a barrier connected to the equipment. The equipment can be rated for a maximum pressure that is less than a maximum reservoir pressure and equal to or greater than the maximum reservoir pressure less external hydrostatic pressure experienced by the equipment. The barrier is rated for a maximum pressure that is equal to or greater than the maximum reservoir pressure.

Figure 1:
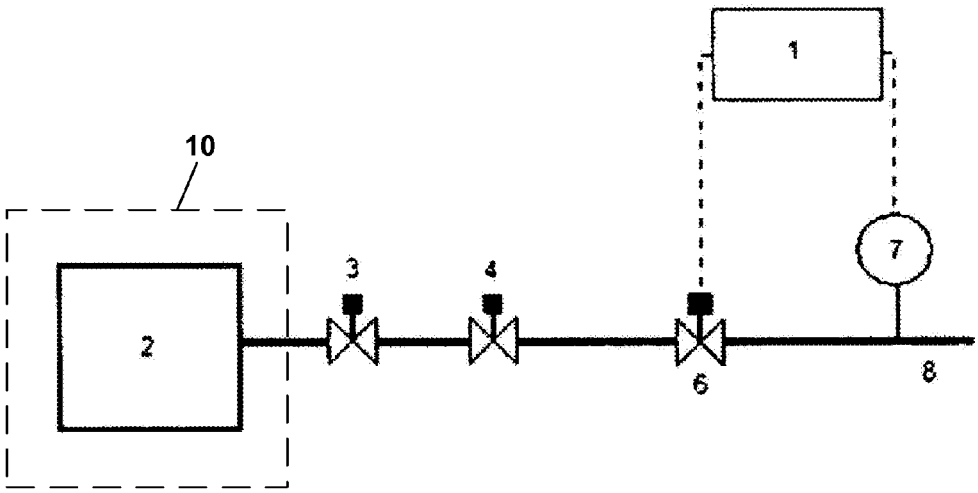
FIG. 1 illustrates an embodiment of the presently disclosed subsea system including a single wellbore according to one embodiment.

In the figures, each reference numeral refers to a particular component of the presently disclosed subsea system, and each reference numeral refers to the same component in each of the figures.

DETAILED DESCRIPTION

A high integrity protection system for subsea equipment is provided in the presently disclosed systems and methods. In some cases, the presently disclosed systems and methods can substantially reduce the costs of subsea equipment by reducing the pressure rating (e.g., the size) of subsea tree valves and/or subsea manifold valves. The presently disclosed systems and methods can also reduce installation/mobilization costs by reducing the weight of subsea equipment. Further, the presently disclosed systems and methods can protect subsea equipment (e.g. pipeline, tree, manifold, valve(s), etc.) from operating across high pressure differentials. The presently disclosed systems and methods can protect the subsea equipment from operating across high pressure differentials by shutting down a barrier (e.g. one or more high pressure rated valves) located downstream of the wellbore.

The presently disclosed subsea system takes into account external hydrostatic pressure experienced by equipment downstream of a wellbore within a reservoir in order to reduce project capital expenditures. The reservoir at an upstream end of the subsea system has a reservoir pressure, which can change as fluids are produced from the reservoir. Of particular importance in the presently disclosed subsea system is a maximum reservoir pressure than may be experienced by the reservoir.

In particular, rather than being rated for a maximum pressure that is equal to or greater than a maximum internal pressure or pressure differential that may be experienced by the equipment (e.g., a pressure equal to the maximum reservoir pressure), the equipment of the presently disclosed subsea system can be rated for a maximum pressure that is less than the maximum reservoir pressure and equal to or greater than the difference of the maximum reservoir pressure less external hydrostatic pressure experienced by the equipment. The phrase "net pressure experienced by the equipment" refers to the difference between a maximum internal pressure that may be experienced by the equipment (e.g. the maximum reservoir pressure) less the external hydrostatic pressure experienced by the equipment.

Thus, for example, pipelines can be made with thinner walls, as the pipelines require a lower pressure rating, thereby resulting in reduced capital expenditures for the system. Thinner pipeline walls can reduce the cost of welding, handling, and transportation, as well as allow for a larger variety of installation vessels since tension loads during pipeline lay are reduced. In particular, if a pipeline experiences a maximum internal pressure or pressure differential (e.g., a maximum reservoir pressure) of 20,000 psi and an external hydrostatic pressure of 5,000 psi, rather than rating the pipeline for 20,000 psi, the pipeline can be rated for 15,000 psi (i.e., 20,000 psi less 5,000 psi). Similarly, if the pipeline experiences a maximum internal pressure or pressure differential (e.g., a maximum reservoir pressure) of 15,000 psi and an external hydrostatic pressure of 5,000 psi, rather than rating the pipeline for 15,000 psi, the pipeline can be rated for 10,000 psi (i.e., 15,000 psi less 5,000 psi). As used herein, the term "rated" means structured to withstand a maximum (operating) pressure. Thus, a pipeline rated for 10,000 psi is structured to withstand a maximum (operating) pressure of 10,000 psi.

During blow down operations, a downstream end of the subsea system may be opened to the ambient environment on a platform. Depending on the reservoir pressure, which may approach, for example, 20,000 psi, a pressure differential may result in the system that is greater than a pressure for which the equipment is rated. A major concern during blow down operations is inadvertently reducing pipeline pressure to such an extent that the differential across a shut valve (e.g., a tree valve installed between a wellbore and flow line, such as a production master valve, a production wing valve, or a flow line isolation valve) could exceed the working pressure of valve, as the low pressure (e.g., atmospheric pressure) experienced by the downstream end of the system can propagate in an upstream direction of the system and approach such a shut valve, or even the wellbore if there is no shut valve. Thus, the presently disclosed subsea system further includes a barrier that can be closed in order to prevent damage to the subsea system equipment, the barrier being rated for a maximum pressure that is equal to or greater than a maximum reservoir pressure or a maximum pressure differential that may be experienced by the subsea system. The equipment (to be protected) can be located upstream or downstream of the barrier. As used herein, the phrase "maximum pressure differential" refers to the difference between the maximum reservoir pressure and the minimum pressure downstream of the barrier.

As used herein, the term "barrier" refers to the one or more devices that that can protect equipment of the subsea system from operating under high pressure or across a high pressure differential. In one embodiment, the barrier can be closed in order to protect the equipment from operating across a high pressure differential. In particular, the barrier can comprise at least one valve, but more often comprises at least two valves, such that there is secondary protection. Each valve or other device of the barrier can be structured to withstand a maximum that is equal to or greater than the maximum pressure differential across the barrier. For example, in one embodiment, the barrier is rated for a pressure of between about 10,000 and 25,000 psi, e.g., a pressure of approximately 15,000 psi or 20,000 psi.

In an embodiment, the barrier, and more particularly the one or more valves that comprise the barrier, is operated by a High Integrity Pipeline (or Pressure) Protection System (HIPPS), which reduces high pressures inside a pipeline, downstream of a wellbore, by rapidly closing one or more valves located between the wellhead and the pipeline. In order to minimize the effects of high pressure along the pipeline, HIPPS can be installed as close to the wellhead as possible (e.g., at Christmas trees, pipeline end terminals, or manifolds).

A HIPPS typically includes a choke (i.e., a production choke valve), one or more barrier valves, as well as a control module. Whether or not the choke is included, a reliable pressure reducing element is necessary in order to implement the HIPPS. The choke provides the first line of defense in overpressure situations. During normal operation, the choke does not allow well pressure to reach the pipeline. Fail safe barrier valves can be either slab or ball type and the number of valves depends on the safety integrity level required. The control module can include strain gauge based pressure transmitters, a safety critical control board, solid state switches, solenoid valves, and non safety-critical function elements (e.g., monitoring, communications, and power supply). The safety critical control board, which includes threshold comparators and voting logic, monitors each pressure signal received from the pressure transmitters and compares the pressure signals with a limit value that triggers solenoids, opening barrier valves.

Figure 2:
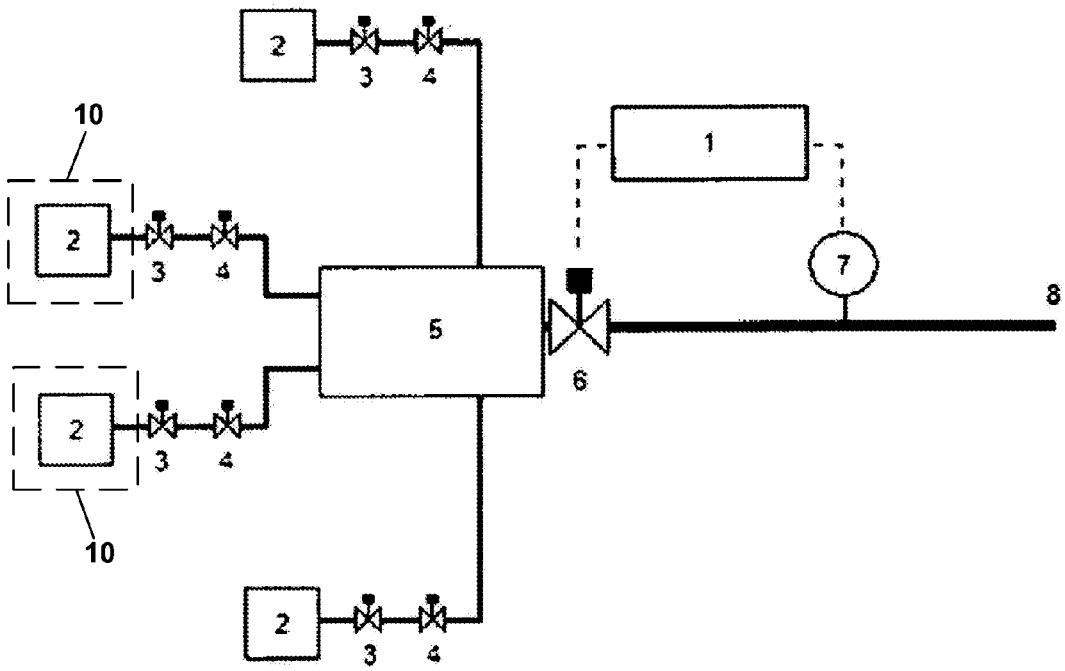
FIG. 2 illustrates an embodiment of the presently disclosed subsea system including multiple wellbores according to another embodiment.

Referring to FIG. 1, in one embodiment, the subsea system includes a control unit 1, a wellbore 2 in a reservoir 10, a production wing valve 3 downstream of the wellbore, a production choke valve 4 downstream of the production wing valve, a barrier valve 6 downstream of the production choke valve, and a pressure transmitter 7 for measuring the pressure in a pipeline 8 downstream of the barrier valve. In some cases, the system can be configured to receive fluids from multiple wellbores 2. For example, as illustrated in FIG. 2, the subsea system can include a control unit 1, multiple wellbores 2 in a single or multiple reservoirs 10, production wing valves 3 downstream of each of the wellbores, production choke valves 4 downstream of each of the production wing valves, a manifold 5 downstream of the production choke valves, a barrier valve 6 downstream of the manifold, and a pressure transmitter 7 in a pipeline 8 downstream of the barrier valve. As illustrated in FIGS. 1 and 2, the equipment to be protected can comprise a pipeline, for example, a pipeline many miles long that extends along an ocean floor. In an embodiment, the equipment is rated for a pressure of approximately 10,000 psi.

The subsea system can include more than one barrier valve, as noted above, and/or one or more pressure transmitters. In particular, FIG. 3 illustrates a subsea system including more than one barrier valve (i.e., two barrier valves), while FIG. 4 illustrates a subsea system including more than one pressure transmitter (e.g., one pressure transmitter upstream of the barrier valve and one pressure transmitter downstream of the barrier valve).

Figure 3:
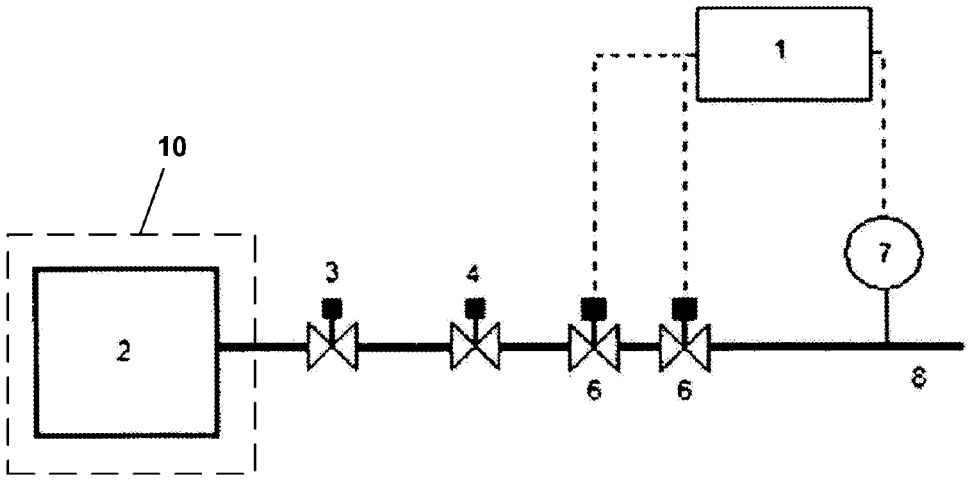
FIG. 3 illustrates an embodiment of the presently disclosed subsea system including a single wellbore according to another embodiment.
Figure 4:
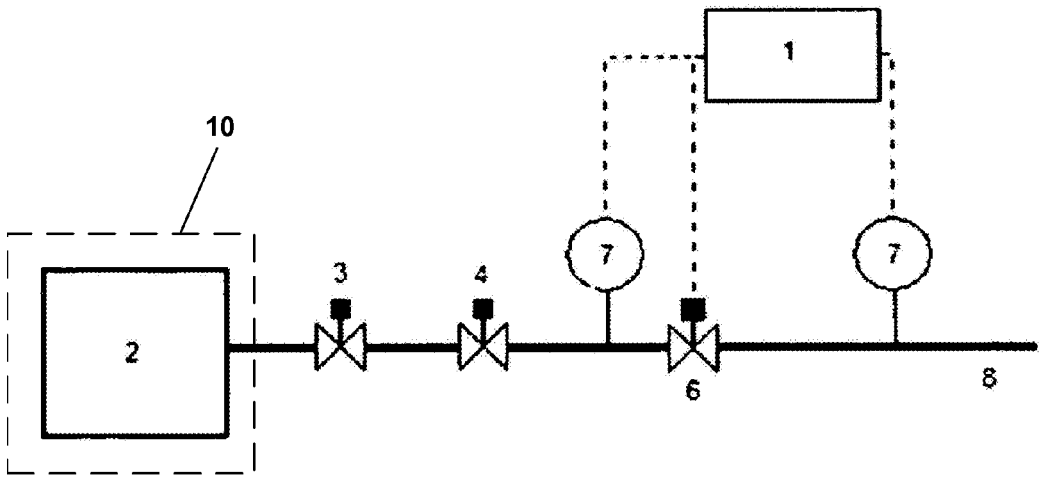
FIG. 4 illustrates an embodiment of the presently disclosed subsea system including a single wellbore according to another embodiment.

Specifically, FIG. 3 illustrates a subsea system that includes a control unit 1, a wellbore 2, a production wing valve 3 downstream of the wellbore, a production choke valve 4 downstream of the production wing valve, two barrier valves 6 downstream of the production choke valve, and a pressure transmitter 7 in a pipeline 8 downstream of the barrier valves. FIG. 4 illustrates a subsea system that includes a control unit 1, a wellbore 2, a production wing valve 3 downstream of the wellbore, a production choke valve 4 downstream of the production wing valve, a first pressure transmitter 7 downstream of the production choke valve, a barrier valve 6 downstream of the first pressure transmitter, and a second pressure transmitter 7 for measuring the pressure in a pipeline 8 downstream of the barrier valve.

The use of more than one barrier valve in the subsea system can increase the safety level of the subsea system. In particular, if the subsea system comprises more than one barrier valve, and one of the barrier valves fails, the remaining barrier valve(s) can protect equipment of the subsea system from operating under high pressure or across a high pressure differential. The use of more than one pressure transmitter in the subsea system can allow for flexibility in pressure measurements within the subsea system. For example, use of more than one pressure transmitter allows for individual measurement of pressure at more than one location within the subsea system (i.e., at the locations of the pressure transmitters) and also allows for measurement of pressure differential between locations within the subsea system (i.e., between the locations of the pressure transmitters), e.g., so that the control unit 1 can operate the barrier valve(s) 6 according to the various pressures and/or the difference between the pressures measured by the valves 7.

In an embodiment, the subsea system can also include one or more barrier valves upstream of a manifold in addition to or instead of one or more barrier valves downstream of the manifold. In particular, FIG. 5 illustrates a subsea system including two barrier valves upstream of a manifold and two barrier valves downstream of the manifold, while FIG. 6 illustrates a subsea system including two barrier valves upstream of a manifold and no barrier valves downstream of the manifold.

Figure 5:
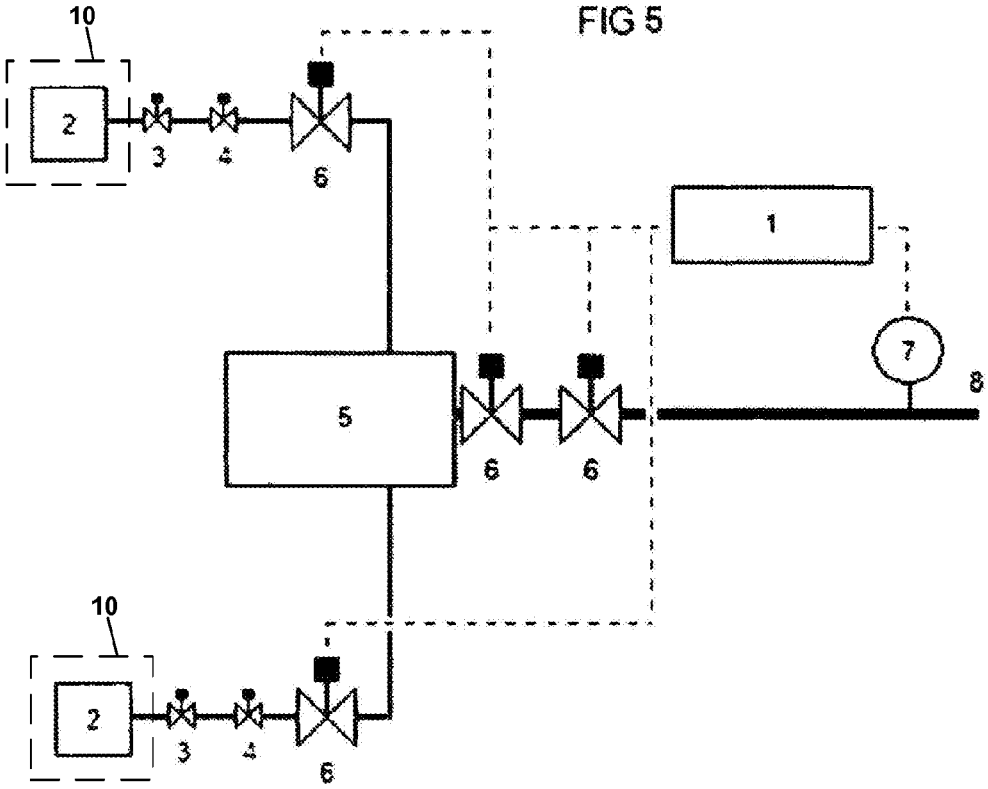
FIG. 5 illustrates an embodiment of the presently disclosed subsea system including multiple wellbores according to another embodiment.
Figure 6:
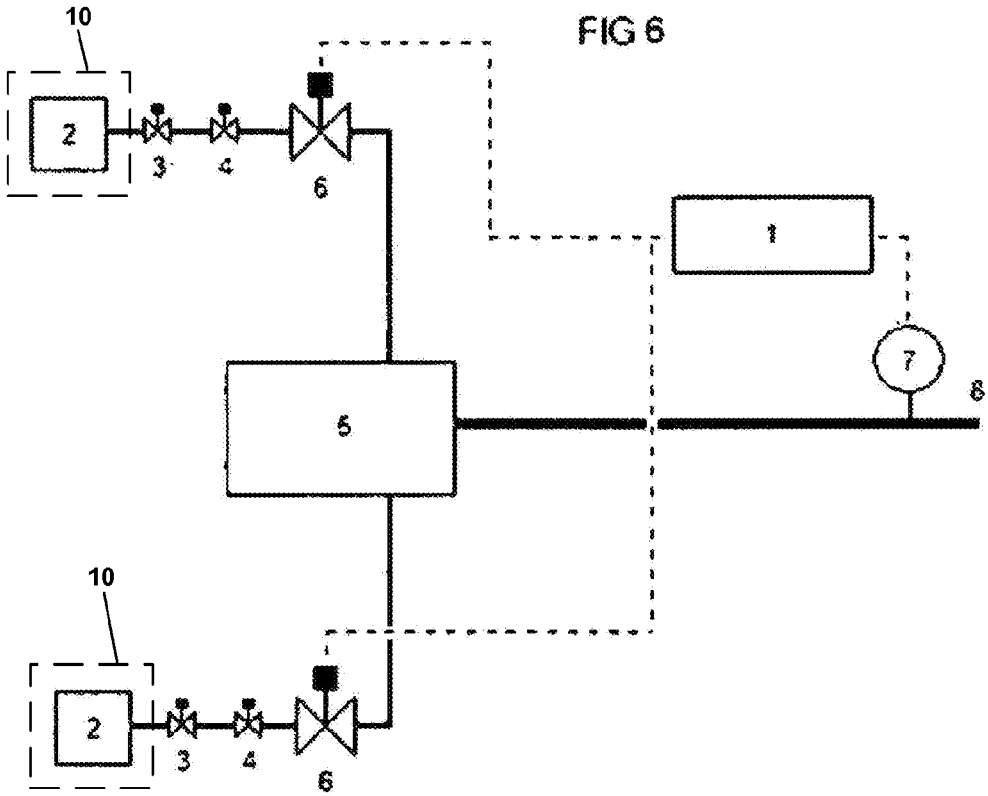
FIG. 6 illustrates an embodiment of the presently disclosed subsea system including multiple wellbores according to another embodiment.

Specifically, FIG. 5 illustrates a subsea system that includes a control unit 1, multiple wellbores 2, production wing valves 3 downstream of each of the wellbores, production choke valves 4 downstream of each of the production wing valves, barrier valves 6 downstream of each of the production choke valves, a manifold 5 downstream of the barrier valves, two barrier valves 6 downstream of the manifold, and a pressure transmitter 7 in a pipeline 8 downstream of the barrier valves. FIG. 6 illustrates a subsea system that includes a control unit 1, multiple wellbores 2, production wing valves 3 downstream of each of the wellbores, production choke valves 4 downstream of each of the production wing valves, barrier valves 6 downstream of each of the production choke valves, a manifold 5 downstream of the barrier valves, and a pressure transmitter 7 in a pipeline 8 downstream of the manifold.

The use of one or more barrier valves upstream of the manifold can increase the safety level of subsea system as well as allow for flexibility in use of the subsea system. In particular, as noted above, if one of the barrier valves fails, the remaining barrier valve(s) can protect equipment of the subsea system from operating under high pressure or across a high pressure differential. Further, if any problems are encountered with the manifold, the barrier valves upstream of the manifold can be closed in order to isolate the wellbores from the manifold. Additionally, barrier valves upstream of the manifold can be selectively closed in order to isolate specific wellbores from the manifold, while allowing other wellbores to remain connected to the manifold and equipment downstream of the manifold.

As noted above, at least one pressure transmitter can detect pressure in the subsea system, while multiple pressure transmitters can detect a pressure differential in the subsea system. The control unit receives signals from the pressure transmitter(s) and sends signals to the barrier. The barrier can be capable of being closed based on the pressure or the pressure differential detected in the subsea system.

The control unit may be an autonomous device, or it can be part of a subsea control module that controls other parts of the system. In one embodiment, the control unit can compare sensor signals with preset values, and then use built-in logic hardware/software to analyze the data and send control signal(s) to actuator(s) for controlling the barrier valve(s). The pressure transmitter(s) installed in the pipeline that transmit signals to the control unit can be, for example, hydraulic or electric/electronic.

As noted above, the subsea system can further comprise one or more valves downstream of the wellbore and upstream of the barrier. The subsea system can further comprise a second wellbore and a manifold downstream of and connected to the wellbore and the second wellbore. The manifold can be upstream or downstream of the barrier.

Figure 7:
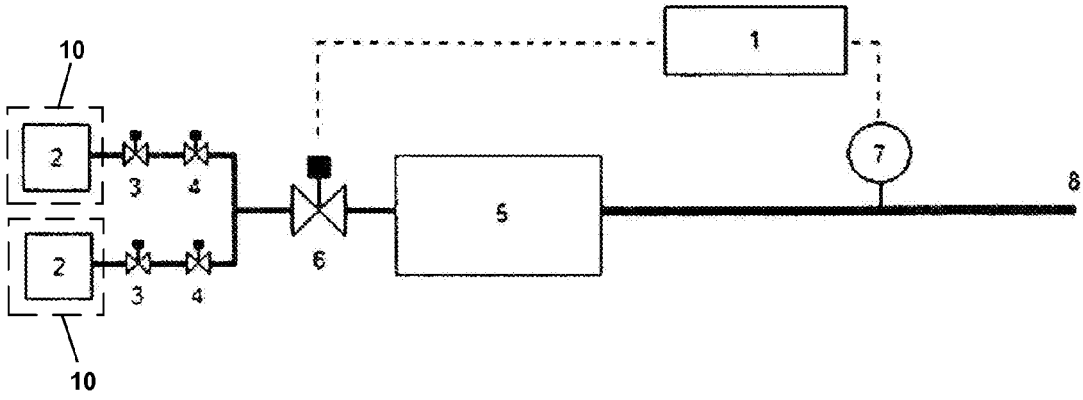
FIG. 7 illustrates an embodiment of the presently disclosed subsea system including multiple wellbores according to another embodiment.
Figure 8:
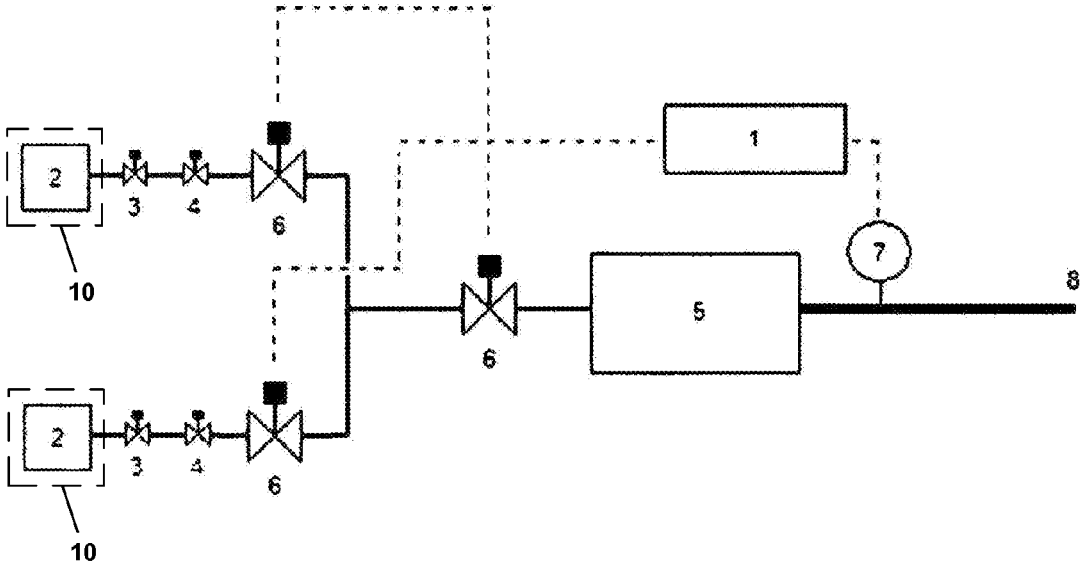
FIG. 8 illustrates an embodiment of the presently disclosed subsea system including multiple wellbores according to another embodiment.

Referring to FIG. 7, in another embodiment, the subsea system includes a control unit 1, multiple wellbores 2, production wing valves 3 downstream of each of the wellbores, production choke valves 4 downstream of each of the production wing valves, a single barrier valve 6 downstream of the production choke valves, a manifold 5 downstream of the barrier valve, and a pressure transmitter 7 in a pipeline 8 downstream of the manifold. Referring to FIG. 8, in an embodiment, the subsea system includes a control unit 1, multiple wellbores 2, production wing valves 3 downstream of each of the wellbores, production choke valves 4 downstream of each of the production wing valves, barrier valves 6 downstream of each of the production choke valves, a barrier valve 6 downstream of each of the barrier valves connected to the production choke valves, a manifold 5 downstream of the barrier valve, and a pressure transmitter 7 in a pipeline 8 downstream of the manifold. With further reference to FIGS. 7 and 8, as noted above, if any problems are encountered with the manifold, the barrier valve directly upstream of the manifold can be closed in order to isolate each of the wellbores from the manifold. With further reference to FIG. 8, as also noted above, the barrier valves connected to the production choke valves can be selectively closed in order to isolate specific wellbores from the manifold, while allowing other wellbores to remain connected to the manifold and equipment downstream of the manifold.

Accordingly, a method for protecting the equipment of the subsea system comprises detecting pressure in the subsea system and closing the barrier if the pressure detected in the subsea system indicates a pressure differential in the subsea system that is greater than a pressure for which the equipment is rated. The method can comprise detected low pressure downstream of the barrier, e.g., closing the barrier if the pressure downstream of the barrier is detected to be less than a predetermined threshold pressure. The method can comprise closing the barrier during blow down of the subsea system.

While various embodiments have been described, it is to be understood that variations and modifications may be resorted to as will be apparent to those skilled in the art. Such variations and modifications are to be considered within the purview and scope of the claims appended hereto.

What is claimed is:

1. A subsea system comprising:

a wellbore within a reservoir;

subsea equipment fluidly connected to the wellbore and downstream of the wellbore, wherein the equipment is rated for a maximum pressure that is (a) less than a maximum reservoir pressure and (b) equal to or greater than the maximum reservoir pressure less external hydrostatic pressure experienced by the equipment; and a barrier fluidly connected to the equipment and configured to control the flow of fluid from the wellbore through the equipment, wherein the barrier is rated for a maximum pressure that is equal to or greater than the maximum reservoir pressure.

2. The subsea system of claim 1, wherein the equipment is upstream of the barrier.

3. The subsea system of claim 1, wherein the equipment is downstream of the barrier.

4. The subsea system of claim 1, wherein the equipment comprises a pipeline.

5. The subsea system of claim 1, wherein the barrier is rated for a pressure of approximately 20,000 psi.

6. The subsea system of claim 1, wherein the equipment is rated for a pressure of approximately 15,000 psi.

7. The subsea system of claim 1, wherein the barrier comprises at least one valve.

8. The subsea system of claim 1, wherein the barrier comprises multiple valves.

9. The subsea system of claim 1, further comprising at least one pressure transmitter for detecting pressure in the subsea system.

10. The subsea system of claim 9, further comprising a control unit that is configured to receive a signal from the at least one pressure transmitter and closing the barrier in response to a pressure detected in the subsea system by the pressure transmitter.

11. The subsea system of claim 10, wherein the control unit is configured to receive signals from a plurality of pressure transmitters and detect a pressure differential in the subsea system.

12. The subsea system of claim 11, wherein the control unit is configured to close the barrier if the pressure differential detected in the subsea system is greater than the pressure for which the equipment is rated.

13. The subsea system of claim 1, further comprising one or more valves downstream of the wellbore and upstream of the barrier.

14. The subsea system of claim 1, further comprising:

a second wellbore; and a manifold downstream of and connected to each of the wellbores, the manifold configured to combine fluids from the wellbores and provide a combined output of fluid from the wellbores.

15. The subsea system of claim 14, wherein the manifold is upstream of the barrier.

16. The subsea system of claim 14, wherein the manifold is downstream of the barrier.

17. The subsea system of claim 16, further comprising an additional barrier downstream of the manifold.

18. A method for protecting equipment of a subsea system, the subsea system comprising a wellbore within a reservoir, equipment downstream of the wellbore, wherein the equipment is rated for a maximum pressure that is less than a maximum reservoir pressure and equal to or greater than the maximum reservoir pressure less external hydrostatic pressure experienced by the equipment, and a barrier connected to the equipment, wherein the barrier is rated for a maximum pressure that is equal to or greater than the maximum reservoir pressure, the method comprising:

detecting pressure in the subsea system; and closing the barrier if the pressure detected in the subsea system indicates a pressure differential in the subsea system that is greater than a pressure for which the equipment is rated.

19. The method of claim 18, wherein the step of closing the barrier is performed upon detection of a pressure downstream of the barrier that is less than a predetermined threshold pressure.

20. The method of claim 18, further comprising closing the barrier during blow down of the subsea system.

* * * * *